US005938542A

United States Patent [19]

Hoffmeyer

[11] Patent Number: 5,938,542

[45] **Date of Patent: *Aug. 17, 1999**

[54] GOLF SHAFT WITH BULGE SECTION

[75] Inventor: Monte J. Hoffmeyer, Estherville, Iowa

[73] Assignee: Berkley, Inc., Spirit Lake, Iowa

[ * ] Notice: This patent is subject to a terminal disclaimer.

[21] Appl. No.: 09/003,268

[22] Filed: Jan. 6, 1998

Related U.S. Application Data

[63] Continuation of application No. 08/664,776, Jun. 14, 1996, Pat. No. 5,735,753, and a continuation-in-part of application No. 08/591,822, Jan. 25, 1996, abandoned

[60] Provisional application No. 60/000,218, Jun. 14, 1995.

[51] Int. Cl.[6] ..... A63B 53/10

[52] U.S. Cl. ..... 473/318; 473/319

[58] Field of Search ..... 473/316, 317, 473/318, 319, 320, 321, 322, 323; 273/DIG. 7, DIG. 23

[56] References Cited

U.S. PATENT DOCUMENTS 5,735,753 4/1998 Hoffmeyer ..... 473/318

*Primary Examiner*—Sebastiano Passaniti
*Attorney, Agent, or Firm*—James W. Miller

[57] ABSTRACT

A composite shaft used in the manufacture of golf clubs includes a straight shaft of tapered form extending between an upper butt end a lower tip end. A radially outwardly protruding bulge section is located on the shaft with the bulge section being spaced from both the tip end of the shaft and the butt end of the shaft. The bulge section has a relatively short length compared to the length of the shaft and is located on the shaft to begin in the lower ⅓ of the shaft length.

17 Claims, 2 Drawing Sheets

GOLF SHAFT WITH BULGE SECTION

CROSS REFERENCE TO RELATED APPLICATIONS

This application is a continuation-in-part of U.S. application Ser. No. 08/591,822, filed Jan. 25, 1996, now abandoned and a continuation of U. S. application No. Ser. 08/664,776, filed Jun. 14, 1996, now U.S. Pat. No. 5,735,753, which claims the benefit of U.S. Provisional Application No. 60/000,218, filed Jun. 14, 1995.

TECHNICAL FIELD

This invention relates to a shaft used in the construction of golf clubs. More particularly, this invention relates to a shaft made of composite materials having a bulge section along its length.

BACKGROUND OF THE INVENTION

The use of composite materials in the construction of shafts for golf clubs is well known. Typically, composite shafts have been formed as straight shafts which taper from a larger diameter butt or grip end to a smaller diameter tip end. A grip material is typically applied to the butt or grip end of the shaft and extends downwardly a short distance for the golfer to use when gripping the club. A club head is secured to the tip end by inserting and affixing the tip end of the shaft to the hosel of the golf club in any known manner.

Traditionally, composite shafts used in the construction of golf clubs have had a uniform taper extending between the butt or grip end and the tip end. In recent years, however, some composite golf shafts have been provided with non-uniform shapes. For example, U.S. Pat. No. 5,265,872 to Tennent et al. discloses a golf club shaft having a modified hourglass shape, with tapered flare sections at the upper and lower ends leading to a narrower central section. U.S. Pat. No. 5,316,299 to Feche et al. discloses a composite golf shaft having a non-uniform configuration formed by a step in the shaft that is proximate to the grip end of the shaft.

SUMMARY OF THE INVENTION

This invention relates to a shaft suited for use as the shaft of a golf club. The shaft comprises a straight shaft having a butt end and a tip end and a predetermined length extending between the butt end and the tip end. A radially outwardly extending bulge section is placed along the length of the shaft with the bulge section beginning within approximately the lower ⅓ of the length of the shaft. The shaft is made of composite materials comprising a resin matrix with reinforcing fibers.

BRIEF DESCRIPTION OF THE DRAWINGS

This invention will be described more completely hereafter in the Detailed Description, when taken in conjunction with the following drawings, in which like reference numerals refer to like elements throughout.

DETAILED DESCRIPTION

This invention comprises a shaft 2 made of composite materials, e.g. materials comprising a resin matrix with reinforcing fibers, for use as the shaft of a golf club. The composite materials preferably comprise graphite composites in which the reinforcing fibers comprise graphite fibers.

More particularly, this invention relates to a golf shaft 2 having a bulge section 4 that begins in approximately the lower ⅓ of golf shaft 2 which provides dynamic stability and control during the golf swing. The placement of bulge section 4 along shaft 2 controls the flexure, torsion and weight distribution of shaft 2 (which comprises the "feel" of golf shaft 2 to the golfer) and provides the manufacturer with the ability to control the trajectory of the flight of the ball upon impact with the golf club.

Figure 1:
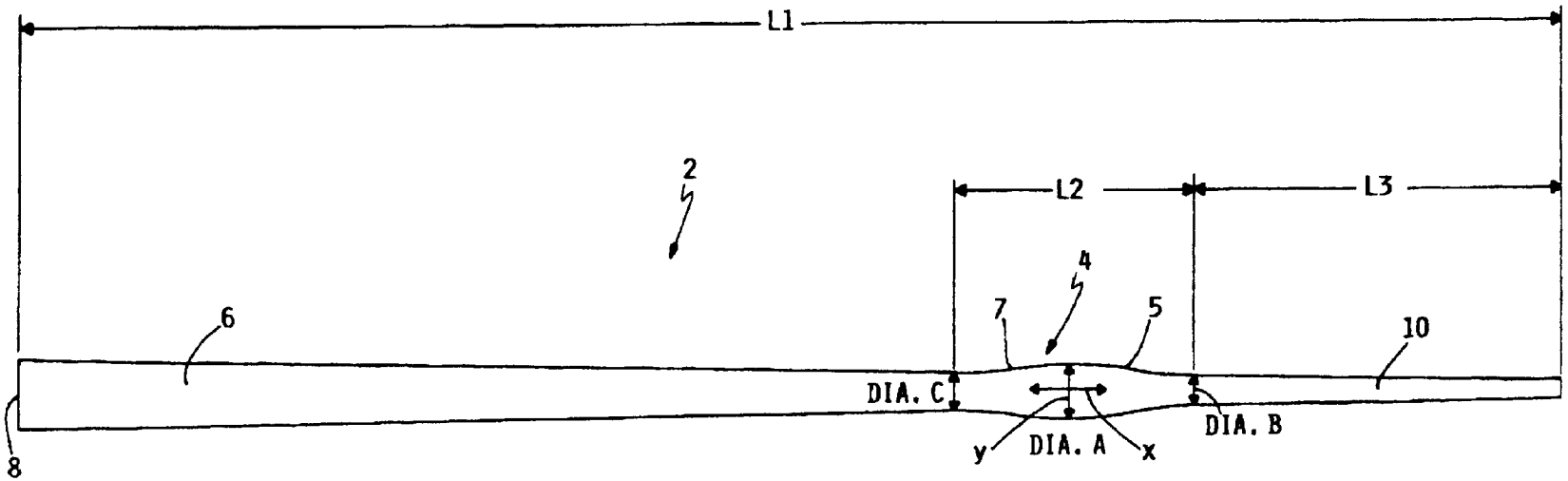
FIG. 1 is a side elevational view of a composite golf shaft according to this invention.

Referring to FIG. 1, shaft 2 is formed as a hollow tapered tube having three major sections. The first section is a grip section 6 that terminates in a free upper butt end 8. Grip section 6 extends downwardly from upper butt end 8 thereof in a generally uniform tapered fashion. The grip material (not shown) of the golf club would be installed on a portion of grip section 6 surrounding upper butt end 8 thereof with the grip material extending downwardly from upper butt end 8 for a short distance along the length of grip section 6.

The second shaft section is a bulge section 4 which bulges outwardly from the lower end of grip section 6. Bulge section 4 has an intermediate portion of maximum diameter, indicated as DIA. A, which is greater than the diameter of the lower end of grip section 6, indicated as DIA. C. As is clear from FIG. 1, bulge section 4 is preferably symmetrically shaped about the longitudinal axis of the shaft, indicated as x in FIG. 1, and about a transverse axis y that is perpendicular to longitudinal axis x and lies along the maximum diameter DIA. A of bulge section 4. Thus, bulge section 4 has a lower section 5 of smoothly increasing diameter that extends from the start of bulge section to the maximum diameter DIA. A of bulge section and then an upper section 7 of smoothly decreasing diameter that extends from the maximum diameter DIA. A of bulge section 4 to the end of bulge section 4. While DIA. A can obviously have various values, it preferably lies in the range of 1.05 to 1.5 times the diameter the shaft would have had at the same point in a uniformly tapered straight shaft. The bulge section 4 of some shafts built by Applicant adds approximately 5% to 10% additional weight to the shaft than the weight of a uniformly tapered straight shaft without bulge section 4.

The third and final section of shaft 2 is a lower tip section 10 to which the head (not shown) of the golf club is attached. This tip section 10 has a maximum diameter DIA. B. which is less than that of the other diameters discussed above, namely less than diameter DIA. A and the diameter DIA. C of the lower end of grip section 6. Tip section 10 terminates in a lowermost tip end 11.

In a shaft 2 used as a wood in a set of golf clubs, the overall length L1 of shaft 2 would be approximately 44 inches long (the length of the shaft blank prior to its assembly into the wood). Bulge section 4 has a length L2 which is approximately 3 to 8 inches long. Preferably, the length L2 should not exceed about 25% of the overall length L1 of the shaft. The distance between the lowermost tip end 11 of golf shaft 2 and the start of bulge section 4, identified in FIG. 1 as length L3, can vary from approximately 3 to 4 inches to 12 inches or so.

The Applicant has found that positioning bulge section 4 in relation to the kick point of shaft 2 yields some unexpected results. The kick point of shaft 2 is that location along the length L1 of shaft 2 that has the greatest amount of deflection during the golfer's swing. If bulge section 4 is raised towards butt end 8 of shaft 2, the Applicant has found that the ball will have a higher trajectory, given identical swing speeds, since the location of the kick point, which is actually above bulge section 4, is effectively lowered. Conversely, if bulge section 4 is lowered towards tip end 11, the Applicant has found that the ball will have a lower trajectory, given identical swing speeds, since the location of the kick point is effectively raised. Accordingly, the Applicant has found that the vertical location of bulge section 4 within the disclosed range affects the trajectory of the ball and different shafts can be designed with a desired characteristic, i.e. either higher or lower ball trajectories, by varying the location of bulge section 4 upwardly or downwardly on the shaft length L1, respectively.

In addition, testing has demonstrated other advantages for a bulge section of the type shown in FIG. 1 and described herein. For example, use of bulge section 4 provides a more consistent ball trajectory even with different swing speeds. Normally, the height or trajectory of a golf ball when struck varies with the swing speed. The higher the swing speed, the higher the trajectory. However, using a shaft 2 as shown and described herein, the ball trajectory is far more constant over a range of swing speeds than in previously known shafts.

Another advantage of use of bulge section 4 is much narrower shot dispersion. In effect, the presence of bulge section 4 keeps the flight of the ball closer to a centerline through the ball even when the ball is struck with the toe and heel portions of the club face. Thus, shafts 2 having a bulge section 4 make the golf club far more forgiving to hits that are off center. Even with an off center hit, the ball will fly and land closer to the center line than for a golf club built with a shaft not having bulge section 4.

Adding bulge section 4 to shaft 2 raises the 1st order natural frequency of the shaft (measured in cycles/minute) and decreases the torque the shaft exhibits. However, the overall stiffness of shaft 2 is not changed. Thus, shaft 2 provides a feeling or illusion to the golfer of added stiffness, yet shaft 2 still plays surprisingly soft despite the higher cycles/minute.

Shaft 2 is made as a hollow tapered tube in any conventional manner known in the art, but preferably by

- Applying sheet(s) of graphite composite material to a straight, non-flexible mandrel;
- Wrapping the graphite composite material around the mandrel;
- Compressing the wrapped graphite composite material on the mandrel;
- Heating the mandrel with the graphite composite material thereon to set or cure the graphite composite material and thereby form a solid graphite composite shaft;
- Pulling the mandrel out of the formed graphite composite shaft; and
- Finishing the formed graphite composite shaft.

In this process, bulge section 4 can be formed by wrapping one or more trapezoidal and/or triangular pennant-shaped patterns around the mandrel in the desired location of bulge section 4 as the outermost layers in that area of shaft 2. As the sheets of graphite composite material are then wrapped around the mandrel, the trapezoidal and/or pennant-shaped patterns will form bulge section 4 with each additional layer in bulge section 4 being progressively narrower simply by virtue of the narrowing shapes of these patterns. Typically, the length of these patterns is chosen so that three to seven additional layers of graphite composite material are provided by each pattern used to form bulge section 4 of shaft 2.

Figure 2:
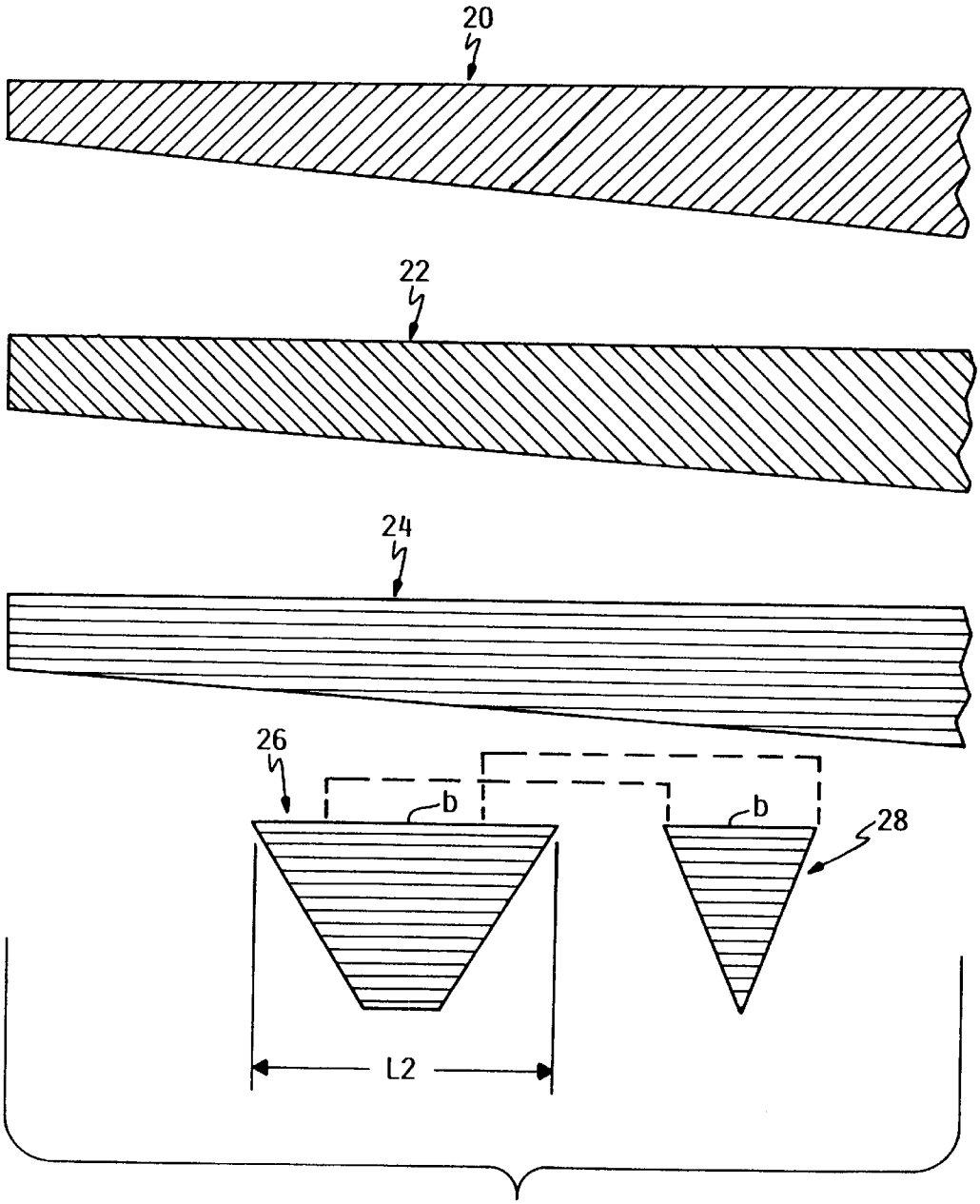
FIG. 2 is a partial, top plan view of the various layers and relative shapes of materials used to make a hollow composite golf shaft according to this invention, the innermost material layers being at the top of FIG. 5 and the outermost layers at the bottom thereof.

FIG. 2 is a depiction of the various patterns 20, 22, 24, 26 and 28 of composite materials which are used to make a graphite composite golf shaft 2 according to this invention. In making such shaft 2, the manufacturing method described above is employed. Thus, the material patterns as shown in FIG. 2 will be wrapped around the mandrel in the order from 22 to 28 with the uppermost pattern 20 in FIG. 2 being wrapped first and then generally proceeding progressively downwardly through the other patterns.

The first three patterns 20, 22 and 24 form the base shaft, i.e. a uniformly tapered shaft without the bulge section 4, while the last two patterns 26 and 28 form the bulge section 4 of shaft 2. The last two patterns 26 and 28 are shown side-by-side in FIG. 2 for clarity, but in practice the triangularly shaped pennant pattern 28 is centered and overlaid onto the top of the trapezoidal pattern 26 as indicated by the dashed lines in FIG. 2. This overlayment is preferably done before these two patterns are wrapped around the mandrel such that the last two patterns 26 and 28 are wrapped together as a unit or preform around the mandrel. The first three patterns 20, 22 and 24 are not shown full length in FIG. 2, but only the lower portions of these patterns forming the lower portion of shaft 2 are shown, the patterns being broken off in FIG. 2 as indicated on the right side of the patterns by the break lines. The full and complete shape of the bulge forming patterns 26 and 28 is shown in FIG. 2.

The reinforcing fibers within the patterns 20–22 and their orientation are shown in FIG. 2 by what appears as a cross-hatching. In the first two patterns of the base shaft, namely the patterns 20 and 22, the fibers are oriented at 45° to the length of the pattern, with the 45° orientation being reversed from one pattern to the next. In the third pattern 24 forming the base shaft, the fibers are oriented at 0° to the length of the pattern, i.e. the fibers run parallel to the length of the pattern. The 0° fiber orientation is also true for the bulge forming patterns 26 and 28.

The trapezoidal pattern 26 is in the shape of a truncated isosceles triangle with the base b having a length L2 that is equal to the desired overall length L2 of bulge section 4. The triangle is truncated at the other end when its width is about 25% of the length L2. Thus, if the base b of pattern 26 has a width L2 of 8 inches, then the truncated end of pattern 26 is 2 inches wide. The overall length along the base b of triangular pattern 28 is half that of the base b of trapezoidal pattern. Thus, if the base b of pattern 26 has a width L2 of 8 inches, then the base b of triangular pattern 28 is 4 inches wide. As noted earlier, triangular pattern 28 will overlie and be centered on trapezoidal pattern 26.

In building a set of irons with this arrangement of patterns 20–28, the Applicant has formed bulge sections having an overall length L2 of 8 inches. The bulge section has begun at a distance from the tip, i.e. the distance L3, of various values, such as 6 inches, 8 inches, 10 inches and 12 inches. Since the overall shaft length L1 in a set of irons is from 35 to 41 inches or so, the beginning of the bulge section 4 is desirably always within approximately the lower ⅓ of the shaft length ($^{12}/_{35}$=0.34). The end point of the bulge section 4 will not extend past the second third of the shaft length ($^{20}/_{35}$=0.57). Obviously, if a shorter length bulge section L2 is used, say a bulge section length L2 of 6 inches, and this section is only spaced away from the tip by 6 inches, then both the beginning and end points of the bulge section would lie within approximately the lower ⅓ of the shaft length.

In building shafts 2 with bulge sections 4, the Applicant has constructed the shafts 2 on a mandrel having a step down near its lower end with this step down being located within the length of the shaft covered by bulge section 4. Thus, using a step down mandrel with the amount of step down that would be typically used in building a golf shaft, the interior bore of the shaft 2 would not be purely uniform, but would have a slightly increased thickness from the point where the step down takes effect. However, this step down does not appear to have any appreciable effect on the performance of shaft 2. Applicant has found through testing that shafts 2 with bulge sections 4 built on mandrels having no step downs, i.e. where the interior bore of shaft 2 would be a uniform taper, perform about as well as shafts 2 with identical bulge sections that were built on mandrels with step downs.

In some of the above noted shafts built by Applicant having a bulge of 8 inches in length, the three patterns 20, 22, and 24 that form the base shaft each contribute about 2.5 wraps or concentric layers of composite material, for a total of about 7.5 to 8.0 layers of thickness in the base shaft. The two patterns 26 and 28 forming bulge section 4 are sized to each contribute about 4.5 additional wraps or concentric layers at the midpoint of bulge section 4, or a total of about 9 additional layers of thickness at the midpoint of the bulge.

Generally conventional composite materials of the type used in the manufacture of golf shafts can be used both in the base shaft patterns 20, 22 and 24 and in the bulge section patterns 26 and 28. One suitable material is a graphite composite material known as Newport NCT303-G120. This material is a commonly available graphite prepreg having 120 grams of graphite fibers per square meter of material. This same Newport material is used as the material in all patterns 20–28 of shaft 2, with the exception that the fiber orientation within the material varies between some of the patterns. Other similar composite prepregs could be used in place thereof.

Various modifications of this invention will be apparent to those skilled in the art. Thus, the scope of the invention is to be limited only by the appended claims.

I claim:

1. A shaft suited for use as the shaft of a golf club, comprising:

a straight shaft made of composite materials comprising a resin matrix with reinforcing fibers with the shaft extending between an upper butt end and a lower tip end, the shaft including a radially outwardly protruding bulge section located on the shaft with the bulge section being spaced from both the tip end of the shaft and the butt end of the shaft, wherein the bulge section has a midpoint and is symmetrically shaped about a transverse axis extending through the midpoint which transverse axis is perpendicular to a longitudinal axis through the shaft, and wherein the shaft has a variable outer diameter along the length of the bulge section characterized by outer diameters at either end of the bulge section which are smaller than a maximum outer diameter substantially at the midpoint of the bulge section.

2. The shaft of claim 1, wherein the outer diameter of the shaft over the bulge section smoothly increases from a lower end of the bulge section to the midpoint and then smoothly decreases from the midpoint to an upper end of the bulge section.

3. The shaft of claim 1, wherein the entire bulge section is located within approximately a lower ⅓ of the length of the shaft.

4. The shaft of claim 1, wherein the bulge section is also symmetrically shaped about the longitudinal axis of the shaft.

5. The shaft of claim 4, wherein the shaft has substantially circular cross-sectional profiles over the bulge section.

6. The shaft of claim 5, wherein the shaft has substantially circular cross-sectional profiles over most of its length including over the bulge section.

7. The shaft of claim 1, wherein the bulge section begins approximately 3 to 12 inches from the tip end of the shaft.

8. The shaft of claim 1, wherein the bulge section is also formed of composite materials comprising a resin matrix with reinforcing fibers.

9. The shaft of claim 8, wherein the bulge section provides additional composite material such that the bulge section adds mass to the shaft compared to a shaft without the bulge section.

10. The shaft of claim 9, wherein the bulge section is formed from at least two patterns of composite material that are rolled up to form the bulge section, the patterns comprising a trapezoidal pattern and a triangular pattern overlaid on top of the trapezoidal pattern.

11. The shaft of claim 10, wherein the triangular pattern shorter than the trapezoidal pattern and is centered on the trapezoidal pattern when the triangular pattern is overlaid onto the trapezoidal pattern.

12. The shaft of claim 11, wherein the trapezoidal pattern is in the shape of a truncated isosceles triangle.

13. The shaft of claim 12, wherein the trapezoidal pattern has a length on one en that is equal to the length of the bulge section and is truncated at an opposite end when its length is about 25% of the length of the bulge section.

14. A shaft suited for use as the shaft of a golf club, comprising:

a straight shaft having a butt end and a tip end and a predetermined length extending between the butt end and the tip end, a radially outwardly extending bulge section placed along the length of the shaft with the bulge section lying entirely within approximately a lower ⅓ of the length of the shaft, the shaft and bulge section both being made of composite materials comprising a resin matrix with reinforcing fibers.

15. The shaft of claim 14, wherein the shaft above the bulge section uniformly tapers outwardly to have a steadily increasing outer diameter to the butt end of the shaft.

16. The shaft of claim 14, wherein the shaft has a variable outer diameter along the length of the bulge section characterized by outer diameters at either end of the bulge section which are smaller than a maximum outer diameter at a location somewhere between the ends of the bulge section.

17. The shaft of claim 15, wherein the maximum outer diameter is at a midpoint of the bulge section.

* * * * *